US008512145B2

(12) United States Patent
Kim et al.

(10) Patent No.: US 8,512,145 B2
(45) Date of Patent: Aug. 20, 2013

(54) ONLINE GAME SYSTEM AND METHOD THEREOF

(75) Inventors: Hong Hee Kim, Gyeonggi-do (KR); Sung Woo An, Seoul (KR); Eun Yong Ha, Gyeonggi-do (KR)

(73) Assignee: NHN Corporation, Seongnam-si (KR)

( * ) Notice: Subject to any disclaimer, the term of this patent is extended or adjusted under 35 U.S.C. 154(b) by 1029 days.

(21) Appl. No.: 12/323,441

(22) Filed: Nov. 25, 2008

(65) Prior Publication Data

US 2009/0082113 A1 Mar. 26, 2009

Related U.S. Application Data

(63) Continuation of application No. PCT/KR2007/002675, filed on Jun. 1, 2007.

(30) Foreign Application Priority Data

Jun. 7, 2006 (KR) ..... 10-2006-0051153

(51) Int. Cl.
*A63F 9/24* (2006.01)

(52) U.S. Cl.
USPC ..... 463/42; 463/29; 463/40

(58) Field of Classification Search
USPC ..... 463/29, 40, 42
See application file for complete search history.

(56) References Cited

U.S. PATENT DOCUMENTS

| | | | |
|---|---|---|---|
| 2002/0115488 | A1 | 8/2002 | Berry et al. |
| 2003/0190960 | A1 | 10/2003 | Jokipii et al. |

FOREIGN PATENT DOCUMENTS

| | | |
|---|---|---|
| JP | 2005-521541 | 7/2005 |
| JP | 2005-293591 | 10/2005 |
| KR | 10-2000-0018155 | 4/2000 |
| KR | 10-2002-0024030 | 3/2002 |
| KR | 10-2005-0118516 | 12/2005 |
| WO | 03/088161 | 10/2003 |

*Primary Examiner* — Dmitry Suhol
*Assistant Examiner* — Andrew Kim
(74) *Attorney, Agent, or Firm* — H.C. Park & Associates, PLC

(57) ABSTRACT

Disclosed is an online tournament game system including a game providing module configured to provide a game for a plurality of players that join a virtual game room during a predetermined game session, a first ranking determination module configured to compute a point value balance of each player based on result of game play committed by the players and to determine rankings of the players based upon the point value balance of each of the players during the first time period, and a player selection module configured to select and assign players for the second time period based upon the rankings of the players during the first time period. The predetermined game session includes a first time period and a second time period in a sequence. Each of the players either gains or loses a point value depending on result of their game play.

17 Claims, 13 Drawing Sheets

FIG. 6

| obtained point table by channel | | |
|---|---|---|
| channel | money | obtained point |
| pool 2 | four billion | one point |
| pool 1 | one hundred million | one point |
| champion 3 | five billion | one point |
| champion 2 | one billion and six hundred million | one point |
| champion 1 | eight hundred million | one point |
| grand | one hundred and sixty million | one point |
| masters | thirty million | one point |
| professional | three million | one point |
| senior | four hundred thousand | one point |
| amateur | sixty thousand | one point |
| junior | thirty thousand | one point |
| novice | twenty thousand | one point |

FIG. 7

| ranking point by win rate | | | | |
|---|---|---|---|---|
| average value | 22000 | | | |
| ranking adding | 20000 | | StartPoint | 10000 |
| probability adding | 0.02 | | MaxPoint | 72000 |
| probability subtracting | 0.05 | | LowPoint | 10000 |
| | | | | |
| | ranking point | win rate | ranking point | win rate |
| | 22000 | 50% | 22000 | 50% |
| | 24000 | 52% | 20000 | 45% |
| | 26000 | 54% | 18000 | 40% |
| | 8000 | 56% | 16000 | 35% |
| | 30000 | 58% | 14000 | 30% |
| | 32000 | 60% | 12000 | 25% |
| | 34000 | 62% | 10000 | 20% |
| | 36000 | 64% | 8000 | 15% |
| | 38000 | 66% | 6000 | 10% |
| | 40000 | 68% | | |
| | 42000 | 70% | | |
| | 44000 | 72% | | |
| | 46000 | 74% | | |
| | 48000 | 76% | | |
| | 50000 | 78% | | |
| | 52000 | 80% | | |
| | 54000 | 82% | | |
| | 56000 | 84% | | |
| | 58000 | 86% | | |
| | 60000 | 88% | | |
| | 62000 | 90% | | |
| | 64000 | 92% | | |
| | 66000 | 94% | | |
| | 68000 | 96% | | |
| | 70000 | 98% | | |
| | 72000 | 100% | | |

| type / section | amateur | professional |
|---|---|---|
| preliminary match | below grand stadium full betting (superman) | champion stadium full betting (god) |
| main match | tournament exclusive channel for "amateur" | tournament exclusive channel for "professional" |
| semi-final match, | | |
| final match | | |

FIG.11

| type / section | amateur | professional |
|---|---|---|
| preliminary match | no limit in participation money | |
| main match | one trillion | thirty trillion |
| semi-final match, | five trillion | fifty trillion |
| final match | holding money after semi-final match | season final match |

| | | |
|---|---|---|
| season final match | No | fifty trillion |

FIG. 12

| type / section | amateur | professional |
|---|---|---|
| preliminary match | no limit | no limit |
| main match | 1000 person | 1000 person |
| semi-final match | 25 person | 25 person |
| final match | 5 person | 5 person |
| final victory | 1 person | 1 person |
| season tournament championship(6th week Fri. nine oclock ~) | | |
| semi-final match | | 25 person |
| final match | | 5 person |
| final victory | | 1 person |

FIG. 13

| type / section | amateur | professional |
|---|---|---|
| participation standard | all applicants who is Han-game membership and applied to tournament can be joined | |
| participation period | (Sun., Mon., Tue.) Three days / 14:00 ~ 16:00, 21:00 ~ 23:00/ | |
| participation section | below one trillion | over one trillion |
| playing channel | below grand stadium full betting (below superman) | over champion stadium full betting (over god) |
| playing method | Connecting to network in preliminary match participating period after applying to join tournament, thereafter, progress the game in corresponding channel(automatic point acquisition) | |

FIG. 14

| type / section | amateur | professional |
|---|---|---|
| participation standard | preliminary match ranking top 1000 | preliminary match ranking top 1000 |
| participation period | (Thu.) one day / 21:00 ~ 23:00/ | |
| participation section | one trillion | thirty trillion |
| playing channel | tournament exclusive channel for "amateur" | tournament exclusive channel for "professional" |
| playing method | Game is played in room that participant entered automatically at random afterentering channel. In case playing numbers are satisfied, automatically excluded, thereafter, participant should be entered at random to play | |

FIG. 15

| type / section | amateur | professional |
|---|---|---|
| participation standard | main match ranking top 25 | main match ranking top 25 |
| participation period | (Fri.) one day / 21:00 ~ 22:30/ | |
| participation section | five trillion | fifty trillion |
| playing channel | tournament exclusive channel for "amateur" | tournament exclusive channel for "professional" |
| playing method | In league match by group, one top by group progress to final match. However, room transferring is impossible from semi-final match. | |

FIG. 16

| type / section | amateur | professional |
|---|---|---|
| participation standard | semi-final match one top by group | semi-final match one top by group |
| participation period | (Fri.) one day / 22:40 ~ 24:10/ | |
| participation section | money obtained in semi-final match | money obtained in semi-final match |
| playing channel | tournament exclusive channel for "amateur" | tournament exclusive channel for "professional" |
| playing method | Main match one top by group plays game to select weekly final match winner. | |

FIG. 17

| type / section | amateur | professional |
|---|---|---|
| participation standard | No | every weekly top five prizewinner 25 person |
| participation period | | season sixth week(Fri.) weekly semi-final time |
| participation section | | follow weekly semi-final standard |
| playing channel | | tournament exclusive channel for "professional" |
| playing method | In league match by group, season championship is selected among one top by group through final match again. However, it is progressed after the 25 personnel are reached (In case nonattendance expression is made among existing members, next ranking member is selected) | |

FIG. 18

| type / section | amateur | professional |
|---|---|---|
| preliminary match | no limit | no limit |
| main match | one trillion | thirty trillion |
| semi-final match, | five trillion | fifty trillion |
| final match | holding money after semi-final match | holding money after semi-final match |

FIG. 19

| type / section | amateur | professional |
|---|---|---|
| preliminary match | no regulation | |
| main match | rest money is automatically stored excepting participation money - > paid in the end of game | |
| semi-final match, | | |
| final match | | |

FIG. 20

| professional standard(thirty trillion) | | | | |
|---|---|---|---|---|
| basis | 30 mimutes | 1 hour | 1 hour 30 mimutes | 1 hour 45 mimutes |
| 50 billion | 100 billion | 200 billion | 500 billion | one trillion |
| amateur standard(one trillion) | | | | |
| basis | 30 mimutes | 1 hour | 1 hour 30 mimutes | 1 hour 45 mimutes |
| one billion | two billion | five billion | 10 billion | 20 billion |

FIG. 21

| ranking | 1st | 2nd | 3rd | 4th | 5th |
|---|---|---|---|---|---|
| money | 300 trillion | 100 trillion | 50 trillion | 10 trillion | one trillion |
| paying type | paid in merchandise coupon type(later determined) | | | | |
| paying method | individual receipt | | | | |

FIG. 22

| ranking | 1st | 2nd | 3rd | 4th | 5th |
|---|---|---|---|---|---|
| money | 10000 trillion | 1000 trillion | 600 trillion | 300 trillion | 100 trillion |
| paying type | paid in merchandise coupon type(later determined) | | | | |
| paying method | individual receipt | | | | |

FIG. 23

| ranking | 1st | 2nd | 3rd | 4th | 5th |
|---|---|---|---|---|---|
| money | 30000 trillion | 10000 trillion | 5000 trillion | 1000 trillion | 500 trillion |
| paying type | paid in merchandise coupon type(later determined) | | | | |
| paying method | individual receipt | | | | |

ONLINE GAME SYSTEM AND METHOD THEREOF

CROSS-REFERENCE TO RELATED APPLICATION

This application is a continuation of prior International Application PCT Application No. PCT/KR2007/002675 filed on Jun. 1, 2007, which claims the benefit of priority from Korean Patent Application No. 10-2006-0051153 filed on Jun. 7, 2006. The disclosures of International Application PCT Application No. PCT/KR2007/002675 and Korean Patent Application No. 10-2006-0051153 are incorporated herein by reference.

BACKGROUND OF THE INVENTION

The present invention relates to the online game system and method thereof, and the ranking determining system for the online game for multiple players and ranking determining method thereof, more particularly, to the online tournament game open system and method thereof, and ranking determining system and method thereof, which is capable of holding an online tournament game while determining a ranking for the online game including card games (i.e. poker game) played over the network.

Recently, as the communications and network technology have been developed, provided are various kinds of contents providing services using an internet, for example, the service for a chatting, a club, a game, and the shopping mall. In particular, the game providing service among this kind of various contents providing services has the trend that the development speed and the diffusion speed of a service has been drastically increased due to the diffusion of a consumer.

According to this trend, each internet portal site and the on-line game service providers provide various kinds of games, particularly, so-called "network on-line game" which can play the real time game with other gamers over the network. As an example of such network on-line game, there can be various kinds of games such as poker games, racing games, and fighting games.

However, as the kind and the number of the on-line games have been increased, the user can easily move to the on-line game of the other site in case the game is monotonous or makes the user to lose interest. Therefore, it is necessary that each Internet portal web site and online game provider providing the on-line game should offer the excitement of a game through various methods. With this improvement, they could keep their member players.

SUMMARY OF THE INVENTION

Accordingly, an object of the present invention is to solve at least the problems and disadvantages of the related art. The object of the present invention is to provide the online tournament game open system and method thereof, and ranking determining system and method thereof, which is capable of regularly holding an online tournament game while determining a ranking for the online game including Go-stop game, and Poker game played through a network according to a fixed rule so as to continuously maintain a user.

In order to accomplish the object, according to the present invention, provided is an online tournament game system including a game providing server that provides a game for a player of the current time period, for a multiple time period classified according to the temporal sequence during a predetermined period; a player selection server that designates a player of the subsequent time period by selecting the player within a predetermined top ranking among the players of the current time period; and a first ranking determination server that calculates a point value balance of each player by adding or subtracting a win-lose point value according to the result of the game of each player based on a given default point value, after giving the default point value to each player of the current time period respectively, and determines a ranking by comparing the point value balance of each player of the current time period respectively, wherein the first ranking determination server determines the ranking of each player of the current time period, in case the current time period is the time period within the n-th (here, n is a natural number which is smaller than the number of the multiple time period) among the multiple time period.

The present invention comprises processors for processing data; at least one memory storing at least one database; a game providing module configured to provide a game for a plurality of players that join a virtual game room during a predetermined game session; a first ranking determination module configured to compute a point value balance of each player based on result of game play committed by the players and to determine rankings of the players based upon the point value balance of each of the players during a first time period wherein each of the players either gains or loses a point value depending on the result of their game play; and a player selection module configured to select and assign players for a second time period based upon the rankings of the players during the first time period. The predetermined game session includes a first time period and a second time period in a sequence. Here, it is preferable that the player selection server further comprises an application receiver that determines the application period from users connected through an internet and receives the participation application of the game, and designates users who are received by the application receiver as the player of the time period of the first time.

The present invention further comprises a second ranking determination module configured to calculate a money balance based on earned money amount or lost money amount according to the result of game play committed by each player during the first time period and to determine the ranking of the players based on the money balance of the first time period.

Preferably, the win-lose point value-calculating server calculates each win-lose point value by an equation as follows.

$$\text{Win-lose point value} = (\text{earned or lost game money}/\text{unit money amount}) \times \text{unit win-lose point value}.$$

Here, it is preferable that the game providing server further comprises a display management server that manages the playing situation of the game playing in each formed room, the point value balance of each player in each room, and the determined ranking of each player in each room, in order to be displayed to the corresponding players respectively.

According to the present invention, the online tournament game open system and method thereof, and ranking determining system and method thereof is capable of regularly holding an online tournament game while determining a ranking for the online game including Go-stop game, and Poker game played through a network according to a fixed rule so as to continuously maintain a user.

BRIEF DESCRIPTION OF THE DRAWINGS

FIG. 6 is a drawing showing an example of the win-lose point value stored in a point value DB server.

FIG. 7 is a drawing showing an example of the win rate stored in a victory rate DB server.

FIG. 9 is a drawing illustrating the personnel chosen in each time period in the online tournament game league.

FIG. 10 to FIG. 19 are drawings illustrating the examples of the rules of the online tournament game league.

FIG. 20 is a drawing illustrating an example of the bonus money which is given in the online tournament game league.

FIG. 21 to FIG. 23 are drawings showing examples of prize money which is given to the winner in the online tournament game league.

In certain instances, details which are not necessary for an understanding of the present invention or which render other details difficult to perceive may have been omitted. It should be understood that the invention is not necessarily limited to the particular embodiments illustrated herein. Like numbers utilized throughout the various figures designate like or similar parts or structure.

DETAILED DESCRIPTION OF THE INVENTION

Figure 1:
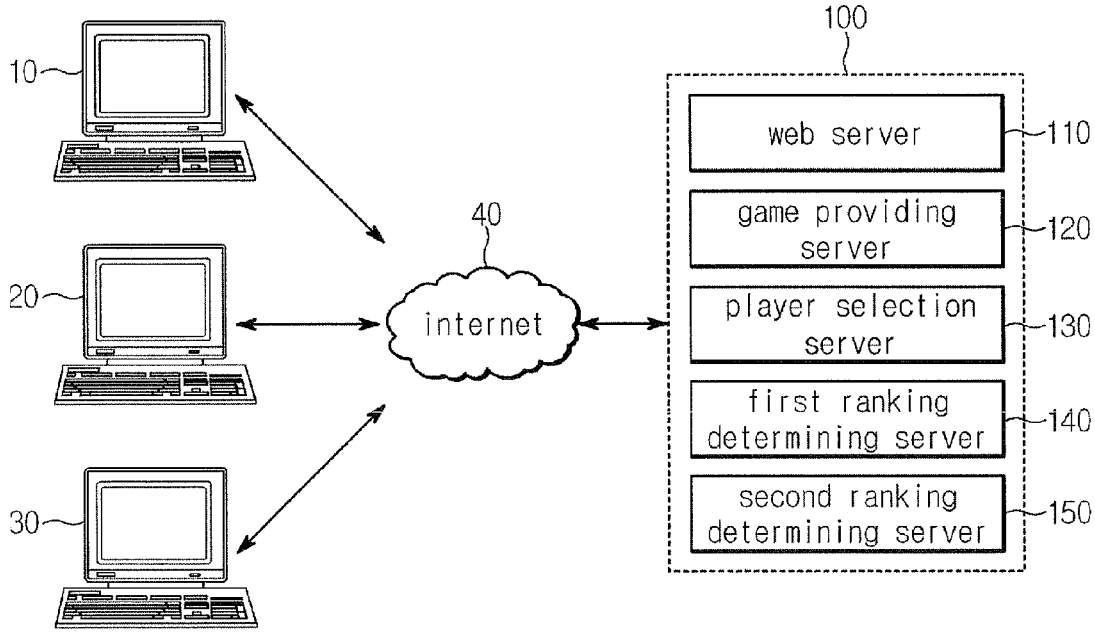
FIG. 1 is a schematic diagram of the online tournament game system according to the present invention.

FIG. 1 is a schematic diagram of the online tournament game system according to the present invention.

FIG. 1 illustrates that multiple users 10, 20, 30 are connected to an online tournament game system 100 over the network 40. Here, the online tournament game system 100 provides a web server 110, a game providing server 120, a player selection server 130, a first ranking determination server 140 and a second ranking determination server 150.

Figure 2:
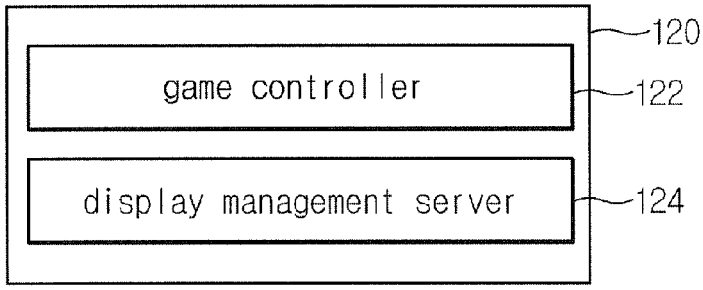
FIG. 2 is a block diagram showing the game providing server of FIG. 1.
Figure 3:
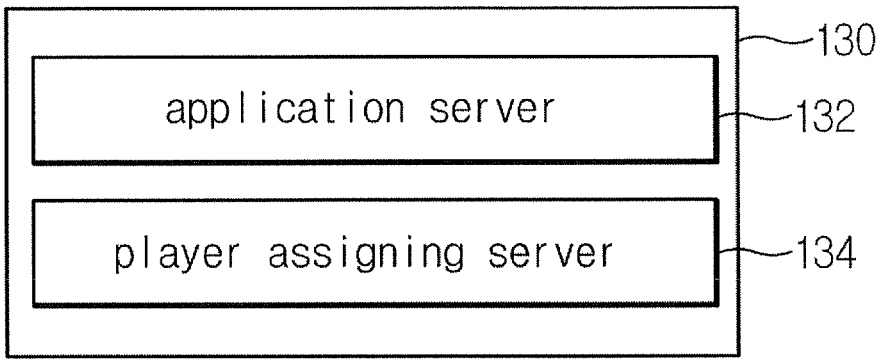
FIG. 3 is a block diagram showing the player selection server of FIG. 1.
Figure 4:
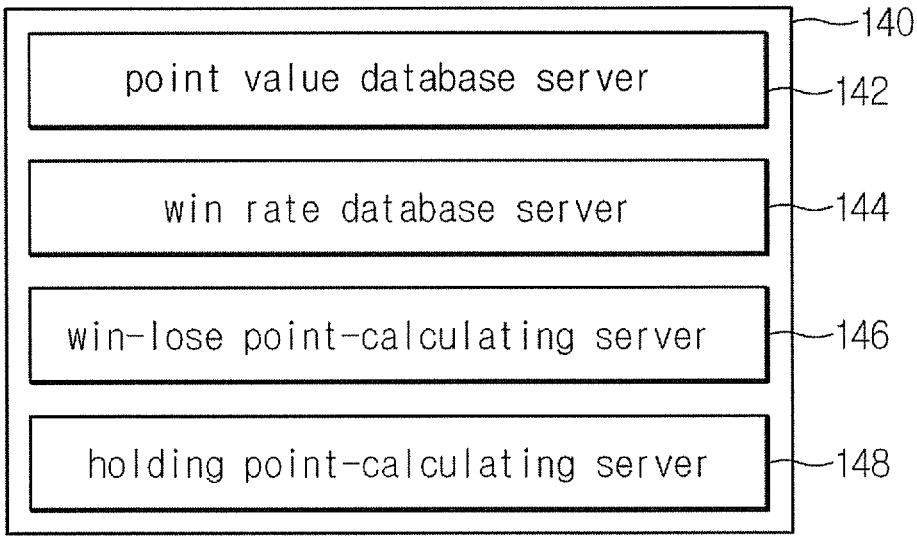
FIG. 4 is a block diagram showing a first ranking determination server of FIG. 1.

Additionally, as shown in FIG. 2, the game providing server 120 includes a game controller 122 and a display management server 124. As shown in FIG. 3, the player selection server 130 includes an application receiver 132 and a player assigning server 134. As shown in FIG. 4, the first ranking determination server 140 includes a point value database server (hereinafter, 'point value DB server' 142), a win rate database server (hereinafter, 'win rate DB server' 144), a win-lose point value-calculating server 146 and a point value balance-calculating server 148.

The web server 110 provides an interface for users 10, 20, 30 connected over the network 40, and provides a selection menu of multiple games through the interface, schedule information of the online tournament game, an input window for membership joining and log-in information.

The game providing server 120 provides a computer game in response to a request from players 10, 20, 30 who have logged on the game website. Here, the game providing server 120 sets up a plurality of time periods for the game, which are divided in a sequence for the players 10, 20, 30 in playing the provided game. The game providing server 120 provides games for each time period.

In one embodiment, it is preferable that the game providing server 120 forms multiple channels for each time period for the game, and provides the game for each channel. Each channel has at least one virtual game room where multiple players play a game together. It is preferable that the players are able to select one channel among those channels when they join the game at the first stage.

In one embodiment, the game providing server 120 can apply different game rules depending on the channels. For example, the game rule on earning point value could be different for each channel or each game room. In further embodiment, the game providing server 120 can apply the same game rule for multiple game rooms in the same channel.

In the meantime, as shown in FIG. 2, the game providing server 120 includes a game controller 122 and a display management server 124. The game controller 122 determines the number of plays for each player assigned to each game room of a channel. In one embodiment, if a player completes the number of plays in one game room, the player would be reassigned to another game room in the same channel. A predetermined number of plays is then supplied to the player. In further embodiment, the number of plays can be determined randomly by the game controller 122.

Additionally, the display management server 124 controls information to be displayed, such as playing status in each game room/channel and point value balances and ranking of the players.

The players assigned to each room can build up their strategies for the game by comparing the point value balance and ranking of his own with the point value balance and ranking of the other players through the displayed screen controlled by the display management server 124. The player selection server 130 selects some of the players who have played in the current time period and allow them into play in the subsequent time period based upon the rankings of the players.

As shown in FIG. 3, the player selection server 130 provides an application receiver 132 which receives the participation application from the players over the network, and a player assigning server 134 which assigns the players to each game room included in each channel.

It is preferable that the player assigning server 134 randomly assigns the players to each game room in the channel. The players are either accepted by the application receiver 132 or selected from the previous time period.

Additionally, the player assigning server 134 reassigns or transfers a player who has completed the predetermined number of plays from one game room to another game room.

The first ranking determination server 140 provides a default point value to each player who is playing the game during the current time period, and adds or subtracts the win-lose point value according to the result of each game for each player. The first ranking determination server 140 also calculates point value balance of each player, and determines the ranking by comparing the point value balance of each player of the current time period respectively. Here, as shown in FIG. 4, the first ranking determination server 140 includes a point value DB server 142, a win rate DB server 144, a win-lose point value-calculating server 146 and a point value balance-calculating server 148.

The point value DB server 142 sets the unit money amount with a different amount of money for each channel formed by the game providing server 120, and stores the unit win-lose point value corresponding to each set unit money amount. Additionally, the win rate DB server 144 classifies the point value in a single step, and allots a different win rate for each classified point value and stores it. At this time, the win-lose point value-calculating server 146 calculates the win-lose point value corresponding to the game money that each player of the current time period earned or lost, based on the win-lose point value stored in the point value DB server 142. The equation for calculating the win-lose point value by the win-lose point value-calculating server 146 is as follows.

Win-lose point value=(earned or lost game money/unit money amount)×unit win-lose point value [Equation 1]

The point value balance-calculating server 148 calculates the current point value balance based on the previous point value balance of each player of the current time period, and the win rate corresponding to the previous point value balance among the win rate stored in the win rate DB server 144. At this time, it is preferable that the point value balance-calculating server 148 calculates the point value balance according to Equation 2 in case of wining in the game, while it calculates the point value balance according to Equation 3 in case of losing in the game.

Point value balance=previous point value balance+win-lose point value×(1−win rate) [Equation 2]

Point value balance=previous point value balance−win-lose point value×win rate [Equation 3]

The second ranking determination server 150 calculates the money balance by adding or subtracting the earned money amount or the lost money amount according to the result of the game of each player based on the basis money of a predetermined money among the money balance of each player of the current time period, and determines the ranking by comparing the money balance of each player of the current time period.

Here, the player selection server 130 designates the player of the subsequent time period based on the ranking of the players of the current time period determined through the first ranking determination server 140 in the first time period or from the first to n-th time period among multiple time periods which are set for a predetermined period. Here, n means the natural number smaller than the number of multiple time periods. At this time, it is preferable that the number of multiple is set as 3 or more, while n is set as 2 or more. Additionally, in the time period after (n+1)-th among multiple time periods, the player selection server 130 designates the player of the subsequent time period based on the ranking of the players of the current time period determined through the second ranking determination server 150. Here, 'time period after (n+1)-th' means the time period after (n+1)-th, including (n+1)-th.

Figure 5:
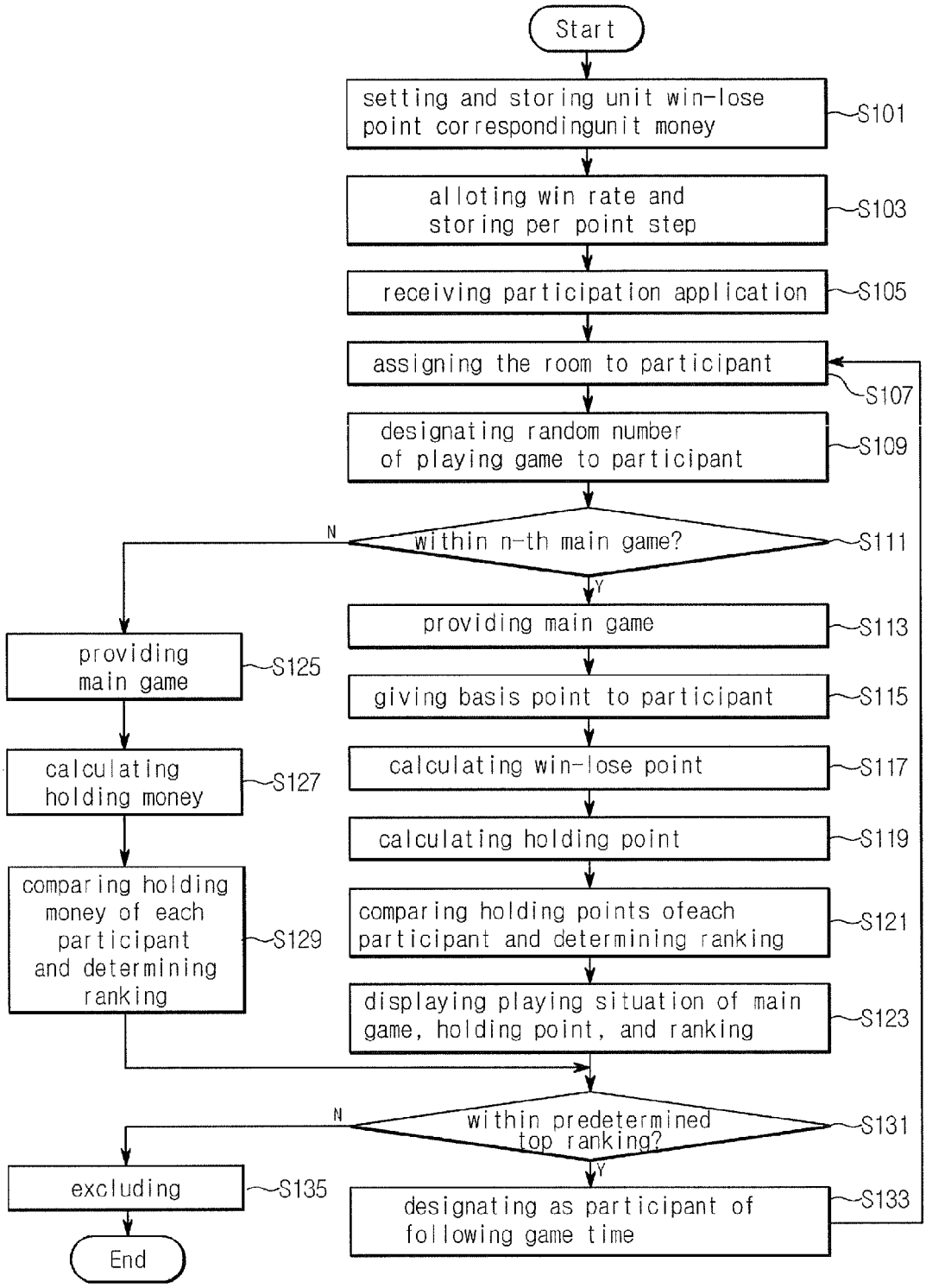
FIG. 5 is a flowchart showing the online tournament game opening method by the online tournament game system of FIG. 1.

FIG. 5 is a flowchart showing the online tournament game opening method by the online tournament game system of FIG. 1. Referring to FIG. 5, the configuration and operation of the online tournament game system will be illustrated in detail.

In the point value DB server 142 of the first ranking determination server 140, the service provider of the online tournament game sets the unit money amount for each channel of the time period as a different amount of money, and sets the unit win-lose point value corresponding to each set unit money amount and stores the set unit win-lose point value (S101).

For example, as shown in FIG. 6, assuming that the formed channel is the novice, the junior, the amateur, the senior, the professional, the masters, the grand, the champion 1, the champion 2, the champion 3, the pool 1 or pool 2, the unit win-lose point value can be set corresponding to the unit money amount which is earned or lost through the game playing in each channel. In the drawing, the unit win-lose point value per unit money amount of 20,000 is set as 1 point value in case of the novice channel, while the unit win-lose point value per unit money amount of 30,000 is set as 1 point value in case of the junior channel. As for the other channels, it is the same as shown in the drawing.

Additionally, in the win rate DB server 144 of the first ranking determination server 140, the service provider of the online tournament game classifies the point value in a single step, and allots a different win rate to each classified point value and stores it (S103).

For example, as shown in FIG. 7, after the point value is classified into multiple steps having the difference of 2,000 point value in a range from 6,000 to 72,000, each point value is stored by assigning a different win rate. For example, the win rate of 50% is assigned based on 22,000 point value, and in case the point value is decreased, the win rate is decreased with 5%, whereas in case the point value is increased, the win rate is increased with 2%. At this time, preferably, while a lower limit and an upper limit are set, the win rate is not any more reduced though the point value becomes smaller than the set range, and the win rate is not any more increased though the point value becomes larger than the set range.

Figure 8:
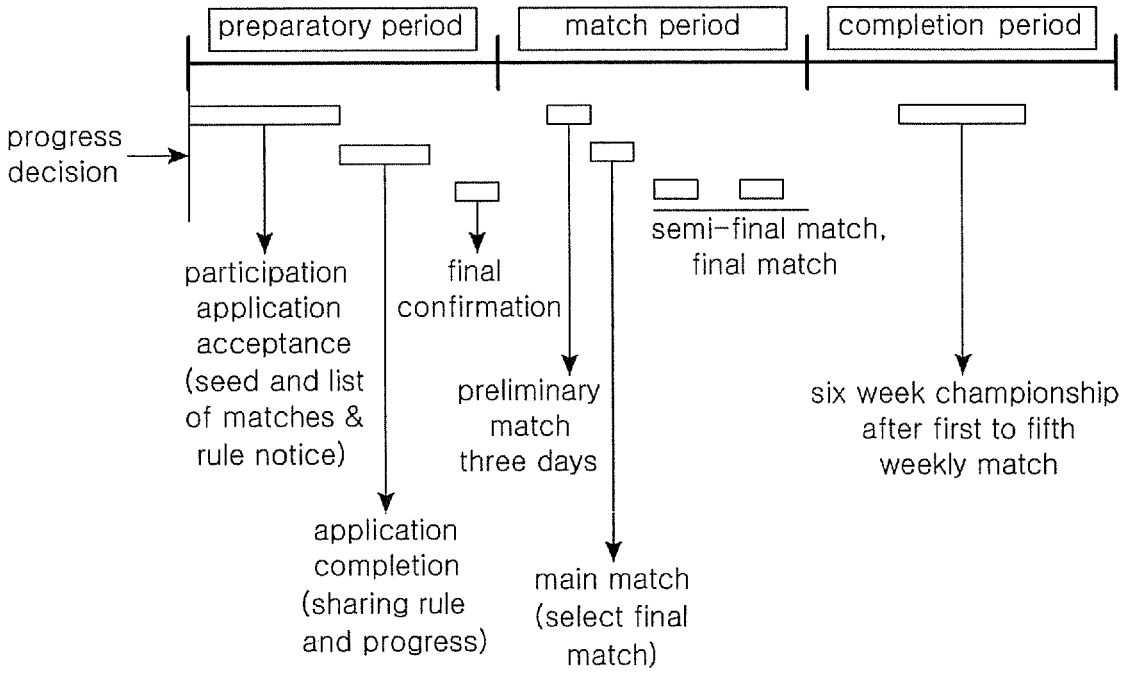
FIG. 8 is a drawing illustrating the progress of the online tournament game league.

The web server 110 provide with a notice of the online tournament game through the provided web page. That kind of notice can include things, for example, illustrated in FIG. 8. For example, the progressing of the online tournament game is noticed through the web page like this:

"The tournament period of the first online tournament game is planning to be held from Sunday, Jun. 11, 2006 to Saturday, Jun. 17, 2006. The participation application of the online tournament game will be received from Jun. 2, 2006 to Jun. 7, 2006. That online tournament game will be held to the fifth online tournament game. Finally, championships will be held between the champions who are selected from the first online tournament game through the fifth online tournament game".

Figures 9, 10:
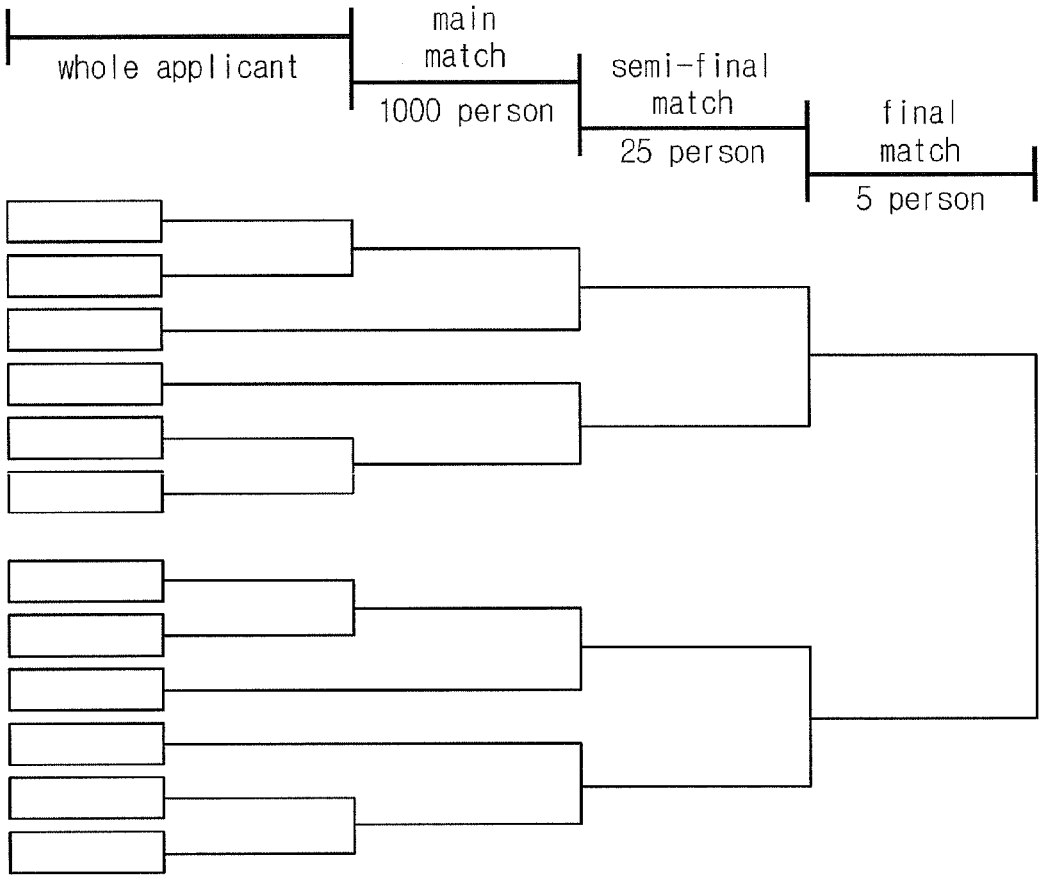

Additionally, as shown in FIG. 9, the web server 110, for each online tournament game, classifies each time period into the preliminary match, the main match, the semi-final match and the final match, and can give a notice of the personnel which is chosen in each time period and the method of selection through the web page.

Additionally, as shown in FIG. 10, the web server 110 divides the online tournament game into the amateur and the professional for the online tournament game to be played, and, as shown in FIG. 11 and FIG. 12, can give a notice of the game progress plan including the participation money of each time period or the personnel chosen in each time period, through the web page. The application receiver 132 of the player selection server 130 receives the first time period, that is, the participation application of the preliminary match during the participation application period which is noticed in the web page by the web server 110 (S105).

As shown in FIG. 13 to FIG. 17, in the web page provided by the web server 110, the content including the joining standards of the preliminary match, the participation application period, the participation division, the playing channel, and the playing method can be noticed.

Additionally, the application receiver 132 receives the application. For example, in case of the poker game, the standards can be set for the money balance that each applicant has respectively. Then, it can be divided into the amateur group and the professional group according to the standards to receive the application. In one embodiment, the player selection server 130 sets applicants who apply the application during the application period as players for a preliminary match.

If it is the start time of the time period, the players can select the channel that they want among multiple channels formed by the game providing server 120. The player assigning server 134 of the player selection server 130, for the players, forms multiple game rooms formed within a predetermined number of people, and assigns the room for providing the game to each group (S107). At this time, it is preferable that the player assigning server 134 forms a group at random for players selecting the same channel, and allots the room.

The game controller 122 of the game providing server 120 designates the number of players playing game within a predetermined number at random for each player who is assigned to his room by the player assigning server 134 (S109). Here, it is preferable that the game controller 122 designates the number of players playing game to each player at random in a predetermined range; for example, the range of twenty times to twenty five times.

In case of the preliminary match, it is illustrated that the player selection server 130 sets all users who applied the application within the application period which is noticed by the web page as the player of the preliminary match. However, in case it is not the first time period, that is, not the time period of the preliminary match, the player selection server 130 determines whether the number of the time period is within the n-th (S111). Here, n is the natural number smaller than the times of multiple time period, and set by the online tournament game service providers.

In case the current time period is the first, or is within from the first to the n-th, the player selection server 130 determines the ranking of the players of the current time period through the first ranking determination server 140. Additionally, in case the current time period is the (n+1)-th or more, the player selection server 130 determines the ranking of the players of the current time period through the second ranking determination server 150. In case it is the first time period or within from the first time period to the n-th time period, and thus, the number of playing game is designated to each player, the game providing server 120 provides the game to each room (S113).

As for the player who is assigned to and entered a room for the first time, the default point value, for example, 10,000 point value is identically given to the whole players (S115). Before the default point value is given, it is regarded that each player does not have any point value. At this time, as for the money balance of each player, it is preferable that, as shown in FIG. 18, only a predetermined basis money is admitted while the rest is stored in a database, in order that the condition of the initial participation stage of each player is made to be identical.

At this time, in case the amateur and the professional are classified according to the money balance that the user who is participating in the online tournament game possesses, the basis money can be differently set according to the degree of the time period. For example, the degree of the time period including the preliminary match, the main match, and the final match.

In case the online tournament game comes to an end, or the player is excluded or secedes from the online tournament game, as shown in FIG. 19, the game money which is kept is naturally paid again. According to the win-lose of the game of each player, the win-lose point value-calculating server 146 calculates the win-lose point value corresponding to the game money that each player of the current time period earned or lost based on the unit win-lose point value stored in the point value DB server (S117).

For example, assuming that the player of the novice channel wins in the first game and obtains the game money of one million won, the win-lose point value can be calculated based on Equation 1.

$$\text{Win-lose point value}=(1{,}000{,}000/20{,}000)\times 1=50$$

The point value balance-calculating server 148 calculates a new point value balance based on the win rate corresponding to the previous point value balance of each player of the current time period, the win-lose point value, and the previous point value balance among the win rate stored in the win rate DB server 144 (S119).

For example, in case of the above player, the previous point value balance is 10,000 point value which is given for the first time, the win-lose point value is 50 point value, and the win rate corresponding to the point value balance is 20%. Therefore, the new point value balance is calculated according to Equation 2 as follows:

$$\text{Point value balance}=10{,}000+50\times(1-0.2)=10{,}040$$

Assuming that the above player is lost in the game, the point value balance is calculated according to Equation 3 as follows:

$$\text{Point value balance}=10{,}000-50\times 0.2=9{,}990$$

As shown in FIG. 20, the time money can be given to each player who is playing the game in the current time period according to a time, besides the default point value. That is, the basis money can be given in the initial stage of the time period, while the time money is given whenever a predetermined time passes, in order to prevent the player from all-in at a time. The first ranking determination server 140 compares the point value balances of each player calculated by the point value balance-calculating server 148 respectively in real-time to determine a ranking (S121). The display management server 124 displays the playing situation of the game playing in the room, the ranking of the players of the current time period determined by the first ranking determination server 140, and the money balance of each player, to a corresponding player by a screen (S123). At this time, it is preferable that the display management server 124 displays together with the ranking and money balance of the opponent who is playing the game in the room.

In case it is the time period of the (n+1)-th or more, and thus, the number of playing game is designated to each player, the game providing server 120 provides the game to each room (S125). In this case, the first ranking determination server 140 stops the determining of ranking while the ranking for the players of the current time period is determined by the second ranking determination server 150.

The second ranking determination server 150 calculates the money balance by adding or subtracting the earned money amount or the loss money according to the result of the game of each player based on the basis money of a predetermined money among the money balance of each player of the current time period (S127), and compares the money balance of each player of the current time period respectively in real-time to determine the ranking (S129).

However, as to the ranking determining method by the second ranking determination server 150, it is not thus restricted. For instance, according to the temporal sequence, in a predetermined time period, the money balance can be calculated by adding or subtracting the earned money amount or the loss money to the basis money, whereas, in the rest time period, the money balance can be calculated by adding or subtracting the earned money amount or the loss money to the whole money balance that each player has without the basis money.

If a player of a game room completes the predetermined number of games, the player assigning server 134 would transfer the player to the other room in the same channel. Like this, while the gamer is replaced in each room, the game is progressed for the time period.

In case it is the end time of the current time period, the player selection server 130 selects the player in a predetermined top ranking among the rankings which are determined by the first ranking determination server 140 or the second ranking determination server 150 during the current time period (S131), and designates the selected player as the player of the subsequent time period (S133). The player who is not designated is excluded (S135). However, in case the gamer designated as the player of the subsequent time period does not join the subsequent time period, or automatically is excluded, the user of pre-order among the excluded gamers can be designated as a player of the subsequent time period.

When the time period of the final match comes to an end—that is, the final time period among multiple time periods played during a predetermined period—the top ranking player who is selected in the time period can be paid to a predetermined prize money. At this time, the prize money can be paid with the game money. Further, as shown in FIG. 21 and FIG. 22, by classifying the winner into the amateur and the professional, a different amount of money can be paid respectively. At this time, FIG. 21 shows the prize money given to the amateur, and FIG. 22 shows the prize money given to the professional.

Additionally, in case the player who is designated by the player selection server, and the general user who is not designated as a player, are countered in the game as an opponent, the first ranking determination server can determine the ranking by comparing the point value balance of the designated player with the point value balance of the other players of the current time period. In this case, the game providing server 120 can allow the player and the non-player to commonly play the game within a predetermined number. For example, within a fixed number such as the preliminary match, or the preliminary match and the main match. In such case, the above mode can be applied just only to the player.

Additionally, as the online tournament game league period progressed from the first to the fourth, for example, the league period progressed through the preliminary match, the main match, the semi-final match and the final match, the tournament period can be repeated several times, and an additional season final match can be progressed by selecting only the winners at the final match. In this case, the final winner at the season final match can be paid the prize money as shown in FIG. 23.

This kind of online tournament game opening method or the ranking determining method can be recorded in a recording medium, and the recording medium can be executed by a computer. For example, such recording medium include a CD (Compact Disc), a DVD (Digital Video Disk), a MD (Mini Disk), and a memory card.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

According to the present invention, as to the online tournament opening system, since the money balance of each player of the first game is different, the game is progressed by endowing a fixed point value, while the money balance of each player is the same. Thus, the initial condition of the game can be identically set. Additionally, the online tournament opening system according to the present invention can maximize the amusement of the game by employing the tournament method where the players of the top ranking are selected as the subsequent time period begins against the players of the first time period.

Thus, there have been shown and described several embodiments of an online game system, which apparatus fulfills all of the objects and advantages sought therefore. Many changes, modifications, variations and other uses and applications of the present constructions will, however, become apparent to those skilled in the art after considering this specification and the accompanying drawings. All such changes, modifications, variations and other uses and applications which do not depart from the spirit and scope of the present invention are deemed to be covered by the invention.

What is claimed is:

1. An online game system, the system comprising:

one or more modules executable by one or more processors using programs and at least one storage device, the one or more modules comprising, a game providing module configured to provide multiple channels for each of a first time period and a second time period for a game for a plurality of players that join a virtual game room during a game session, the game session comprising the first time period and the second time period in a sequence;

a ranking determination module configured to set a unit money amount with a different amount of money for each channel, to store a unit win-lose point value corresponding to each set unit money amount, and to calculate the win-lose point value corresponding to a game money that each of the plurality of players during the first time period earned or lost, based on the win-lose point value stored in a point value database server, wherein the win-lose point value is calculated based on (earned or lost game money /unit money amount)×unit win-lose point value;

a player selection module configured to select players and to assign the selected players for the second time period based upon the win-lose point value of the selected players during the first time period; and a display module configured to concurrently display the win-lose point value and a ranking of the respective players during the first time period and the second time period of the game session.

2. The system of claim 1, further comprising:

a second ranking determination module configured to calculate a money balance based on earned money amount or lost money amount according to results of game play by each player during the first time period and to determine the ranking of the respective players based on the money balance of the first time period.

3. The system of claim 1, wherein the player selection module comprises a player assigning module configured to form game rooms for each of the multiple channels, and to assign a predetermined number of players to each of the game rooms.

4. The system of claim 3, wherein the one or more processors are configured to determine a number of plays to be played by players assigned to each game room, wherein the one or more processors are configured to reassign players one of the game rooms to the other game room in response to detection of the number of plays being completed.

5. The system of claim 1, further comprising:

a win rate database server configured to classify the point value in a single step, and to assign a different win rate for the classified point value, and to calculate the point value balance based on the previous point value balance of each player of the first time period, the win-lose point value, and the win rate corresponding to the previous point value balance among the win rate stored in the win rate database server.

6. The system of claim 1, wherein the ranking determination module is configured to calculate the point value balance by In case of winning: Point value balance=previous point value balance+win-lose point value x (1−win rate)

In case of losing: Point value balance=previous point value balance−win-lose point value x win rate.

7. The system of claim 1, wherein the game providing module comprises a display management module configured to control game status information to be displayed during the first time period and the second time period of the game session.

8. A system for determining rankings of gamers in playing a multiplayer game over a network, the system comprising:

a plurality of modules being configured and executable by processors of servers comprising storage devices, the plurality of modules comprising, a game providing module configured to provide multiple channels for each of a first time period and a second time period for a name for a plurality of players that loin a virtual name room during a game session, the game session comprising the first time period and the second time period in a sequence;

a win-lose point value-calculating module configured to set a unit money amount with a different amount of money for each channel, to store a unit win-lose point value corresponding to each set unit money amount, and to calculate a win-lose point value corresponding to a game money earned or lost by players, based on the win-lose point value stored in a point value database server, wherein the win-lose point value is calculated based on (earned or lost game money /unit money amount)×unit win-lose point value;

a point value balance calculating module configured to calculate point value balance of each of the players by adding or subtracting the win-lose point value by providing a default point value to the each player, wherein the ranking is determined by comparing the point value balance of each of the players; and a display module configured to concurrently display the point value balance and the ranking of the respective players during a game session.

9. A computer-implemented method for managing online games, the method comprising:

providing multiple channels for each of a first period and a second time period for a game for a plurality of players that join a virtual game room during a game session, the game session comprising the first time period and the second time period in a sequence;

providing a default point value to the players of a game room for playing a multiplayer game during the game session;

setting a unit money amount with a different amount of money for each channel, and storing a unit win-lose point value corresponding to each set unit money amount, and calculating a win-lose point value corresponding to a game money earned or lost by each of the players during the first time period, wherein the win-lose point value is calculated based on (earned or lost game money /unit money amount)×unit win-lose point value;

determining a ranking of the respective players by comparing the point value balance of each player during the first time period;

selecting players for the second time period based on the ranking of the respective players during the first time period; and a display module configured to concurrently display the point value balance and the ranking of the respective players during the first time period and the second time period.

10. The method of claim 9, further comprising:

calculating a money balance based on earned money amount or lost money amount from the result of the each player during the first time period; and determining the ranking of the respective players based on the money balance of the first time period.

11. The method of claim 9, further comprising:

forming multiple game rooms for each channel; and assigning a predetermined number of players to each of the game rooms.

12. The method of claim 9, further comprising:

classifying the point value balance; and assigning a different win rate for the classified point value, calculating the point value balance based on the previous point value balance of each player of the current time period, the win-lose point value, and the win rate corresponding to the previous point value balance among the win rate.

13. The method of claim 12, further comprising:

displaying game status information for each game room for the respective players.

14. The method of claim 9, further comprising:

determining a number of players assigned to the game room; and reassigning players to different game room in response to detection of the number of plays being completed.

15. The method of claim 9, wherein the each point value balance is calculated by In case of winning: Point value balance=previous point value balance+win-lose point value x (1−win rate)

In case of losing: Point value balance=previous point value balance−win-lose point value x win rate.

16. A computer-implemented method for determining rankings of gamers in playing a multiplayer game over a network, the method comprising:

providing multiple channels for each of a first time period and a second time period for a game for a plurality of players that join a virtual game room during a game session, the game session comprising the first time period and the second time period in a sequence;

calculating a win-lose point value corresponding to the game money earned or lost by gamers, wherein the win-lose point value is calculated based on (earned or lost game money /unit money amount)×unit win-lose point value, wherein the unit money amount is set with a different amount of money for each channel;

calculating a point value balance of each of the gamers by adding or subtracting the win-lose point value calculated by providing a given default point value to each gamer according to the adding or subtracting the win-lose point value from the default point value, wherein the ranking is determined by comparing the point value balance of each of the players; and concurrently displaying the point value balance of each of the players during the multiplayer game.

17. One or more non-transitory computer-readable storage medium comprising executable computer programs, when executed by one or more processors, causes the one or more processors to perform:

providing multiple channels for each of a first time period and a second time period for a game for a plurality of players that join a virtual game room during a game session and setting a default point value to each player during the game session comprising the first time period and the second time period in a sequence;

setting a unit money amount with a different amount of money for each channel, and storing a unit win-lose point value corresponding to each set unit money amount;

calculating win-lose point value corresponding to a game money earned or lost by each of the players during the first time period, wherein the win-lose point value is calculated based on (earned or lost game money /unit money amount)×unit win-lose point value;

determining rankings of the players based on the point value balance of each player during the first time period, wherein the default point value is provided to each of the players in the first time period;

selecting players for the second time period based on the rankings of the players during the first time period; and concurrently displaying the point value balance of each player during the first time period and the second time period.

* * * * *